US007704195B2

(12) United States Patent
Alessandri et al.

(10) Patent No.: US 7,704,195 B2
(45) Date of Patent: Apr. 27, 2010

(54) GYMNASTIC MACHINE

(75) Inventors: Nerio Alessandri, Longiano (IT); Maurizio Roman, Noale (IT); Simone Casagrande, Rimini (IT)

(73) Assignee: Technogym S.p.A., Gambettola (FC) (IT)

( * ) Notice: Subject to any disclaimer, the term of this patent is extended or adjusted under 35 U.S.C. 154(b) by 398 days.

(21) Appl. No.: 11/603,666

(22) Filed: Nov. 22, 2006

(65) Prior Publication Data

US 2007/0135276 A1 Jun. 14, 2007

(30) Foreign Application Priority Data

Nov. 25, 2005 (IT) ..... RA2005A0044

(51) Int. Cl.
*A63B 21/062* (2006.01)

(52) U.S. Cl. ..... 482/99; 482/102

(58) Field of Classification Search ..... 482/97–102, 482/133, 135, 138, 93
See application file for complete search history.

(56) References Cited

U.S. PATENT DOCUMENTS

| | | | | |
|---|---|---|---|---|
| 931,699 | A * | 8/1909 | Medart | 482/102 |
| 4,603,855 | A * | 8/1986 | Sebelle | 482/103 |
| 5,034,576 | A | 7/1991 | Dalebout et al. | |
| 5,230,680 | A * | 7/1993 | Wu | 482/97 |
| 5,624,362 | A * | 4/1997 | Wilson | 482/139 |
| 5,928,117 | A * | 7/1999 | Vittone et al. | 482/99 |
| 6,050,924 | A | 4/2000 | Shea | |
| 6,447,430 | B1 * | 9/2002 | Webb et al. | 482/98 |
| 6,458,061 | B2 * | 10/2002 | Simonson | 482/103 |
| 6,488,612 | B2 * | 12/2002 | Sechrest et al. | 482/103 |
| 6,527,683 | B2 * | 3/2003 | Tolles | 482/99 |
| 6,582,346 | B1 * | 6/2003 | Lines et al. | 482/102 |
| 6,875,157 | B1 | 4/2005 | Wang et al. | |
| 7,278,958 | B2 * | 10/2007 | Morgan | 482/97 |
| 2004/0072659 | A1 * | 4/2004 | Alessandri et al. | 482/99 |

FOREIGN PATENT DOCUMENTS

| | | | |
|---|---|---|---|
| EP | 1790390 | A1 * | 5/2007 |
| WO | WO 91/07214 | | 5/1991 |

* cited by examiner

*Primary Examiner*—Loan H Thanh
*Assistant Examiner*—Allana Lewin
(74) *Attorney, Agent, or Firm*—Abelman, Frayne & Schwab

(57) ABSTRACT

A gymnastic machine having a frame (10) supporting a load group (30), and at least one gripping station (80) presenting a respective implement (20) for the execution of a physical exercise, with the load group (30) connected to each implement (20) by at least one flexible member (40) supported by the frame (10) through a plurality of pulley-blocks (50) along a route (P), at least one implement (20) connected to flexible member (40) at the respective gripping station (80), and a return device (90) being connected to each implement (20) to restrain the implement (20) itself along the route (P) in at least one uniquely determinate position (DP) with respect to frame (10) in a indefinitely repeatable manner.

22 Claims, 1 Drawing Sheet

GYMNASTIC MACHINE

BACKGROUND OF THE INVENTION

1. Field of the Invention

The present invention relates to a gymnastic machine equipped with a load group comprising at least one implement connected to a flexible member. In particular, the present invention relates to a gymnastic machine equipped with a load group comprising at least one implement freely or rigidly connected to a flexible member. In more detail, the present invention relates to a gymnastic machine equipped a load group comprising at least one implement connected to a flexible member and a locking device for at least one respective implement.

2. Description of the State of the Art

As is well-known, one of the reasons which has led to the success of gymnastic machines is their rigidity of operation which allows to focus on a particular muscle group. These characteristics allow the less athletically prepared user to train with a reasonable certainty of protecting his own well-being, and therefore in total safety. However, the very fact of imposing the execution of particular movements is considered excessively restricting by users who, for reasons of work or inclination, prefer that training with weights should require absolute concentration on handling free loads possibly assembled through equalizers, in order also to actively stimulate their own respective proprioception. In any case, the use of equalizers or free weights requires considerable space, both for the execution of the training exercises and for accommodating the weights and accessories, among them the equalizers themselves. To satisfy the requirements of these more demanding users, and to overcome the disadvantages mentioned above, some manufacturers of gymnastic machines have set out to modify the basic concept of gymnastic machines, and therefore the relative classical structure, in such a way as to make the execution of training exercises freer, with implements connected to cables connected to more or less finely adjustable load groups. In this connection it is as well to recall the machine designated "Ercolina" by the applicant, the inventive concepts of the inventor Roy Simonson, among them U.S. Pat. No. 6,458,061, and Patent Application no. RA2002A000017 by the applicant, which was internationalised by Application no. EP 03022187, all examples of how it is possible to make so-called functional gymnastic machines.

With particular reference to Application no. RA2002A000017, on a machine in which the interface between the load and the implements consists of cables, several load stations are made available, each presenting a respective handle, connected in freely sliding manner or rigidly to a cable between pulley-blocks comprising pulleys. In this way, each handle is grippable in any position on the respective run of cable. This facilitates the use of the machine by users of differing build, and also the execution of exercises devised by each individual user to recruit particular muscle areas in a personalised way. In fact, each handle can be made to run freely along the cable run between two pulley-blocks as far as the desired position if coupled freely to the cable itself, or can be located in a position definable at will between the two pulley-blocks at the end of the exercise, if of the type rigidly connected to the cable. Once the execution of a movement has started, the handle will maintain its reference position along the respective cable run simply because of the fact that, in use, the handle separates two distinct portions on the respective cable run, inclined to each other at a particular angle, which depends on the position in which the handle is gripped and the type of trajectory over which, moment by moment, the handle happens to be moved by the user. It will be noted that, by virtue of what has been said, the handles of the load stations currently not being used are left free to oscillate together with the respective run of cable, which inevitably will be subjected to alternating loads of variable value.

Naturally, this situation makes the use of the machine more annoying the lighter the load selected, and the mass of the oscillating handle is important. Furthermore, these oscillations make these machines potentially dangerous, given that the implements not in use could in particular conditions strike the head or another bodily area of the user without warning. In addition, these machines are noisy because of the continual banging of the handles not in use which are dragged against the pulley-blocks which delimit the respective cable runs during the execution of training.

What has been described above renders such machines less interesting for the market of more advanced users, who consider the disadvantage of the noisiness and the oscillation of the handles not in use discordant with the technical level of these types of machines. The problem, therefore, of the availability of functional gymnastic machines with implements usable over free trajectories which are both mechanically safe and silent is currently unresolved, and represents an interesting challenge for the applicant, who has decided to tackle and resolve it, as will be described below, in order to exploit it economically.

In view of the situation described above, it would be desirable to have available a gymnastic machine provided with a load group which, besides enabling the disadvantages, typical of the state of the known art set forth above, to be limited and if possible overcome, could define a new standard in this sector of the market. Consequently, such a gymnastic machine would prove to be indicated for installation in either a biomedical, or a sporting, or a domestic environment, and therefore in any environment in which gymnastic machines have applications.

SUMMARY OF THE PRESENT INVENTION

The present invention relates to a gymnastic machine equipped with a load group comprising at least one implement connected to a flexible member. In particular, the present invention relates to a gymnastic machine equipped with a load group comprising at least one implement freely or rigidly connected to a flexible member. In more detail, the present invention relates to a gymnastic machine equipped a load group comprising at least one implement connected to a flexible member and a locking device for at least one respective implement.

The object of the present invention is to create a gymnastic machine which will permit the resolution of the disadvantages set forth above, and which will be capable of satisfying a series of requirements to which in the present state of affairs there is no answer (which will be presented in the description which follows) and will therefore be capable of representing a new and original source of economic advantage, able to alter the current market in implements for physical training and rehabilitation.

According to the present invention a gymnastic machine is created, whose principal characteristics will be described in at least one of the claims which follow.

An object of the present invention is also to provide a method for simply and cheaply restoring a gymnastic machine to the condition it was in before use.

According to the present invention a method is also provided for restoring a gymnastic machine to the condition it was in before its respective use, and this method will be described in at least one of the claims which follow.

BRIEF DESCRIPTION OF THE DRAWINGS

Further characteristics and advantages of the gymnastic machine according to the present invention will appear more clearly from the following description, explained by reference to the attached drawings which illustrate some non-limiting examples of embodiment, in which identical or corresponding parts of the device itself are identified by the same reference numbers. In particular.

DETAILED DESCRIPTION OF PREFERRED EMBODIMENTS

Figure 1:
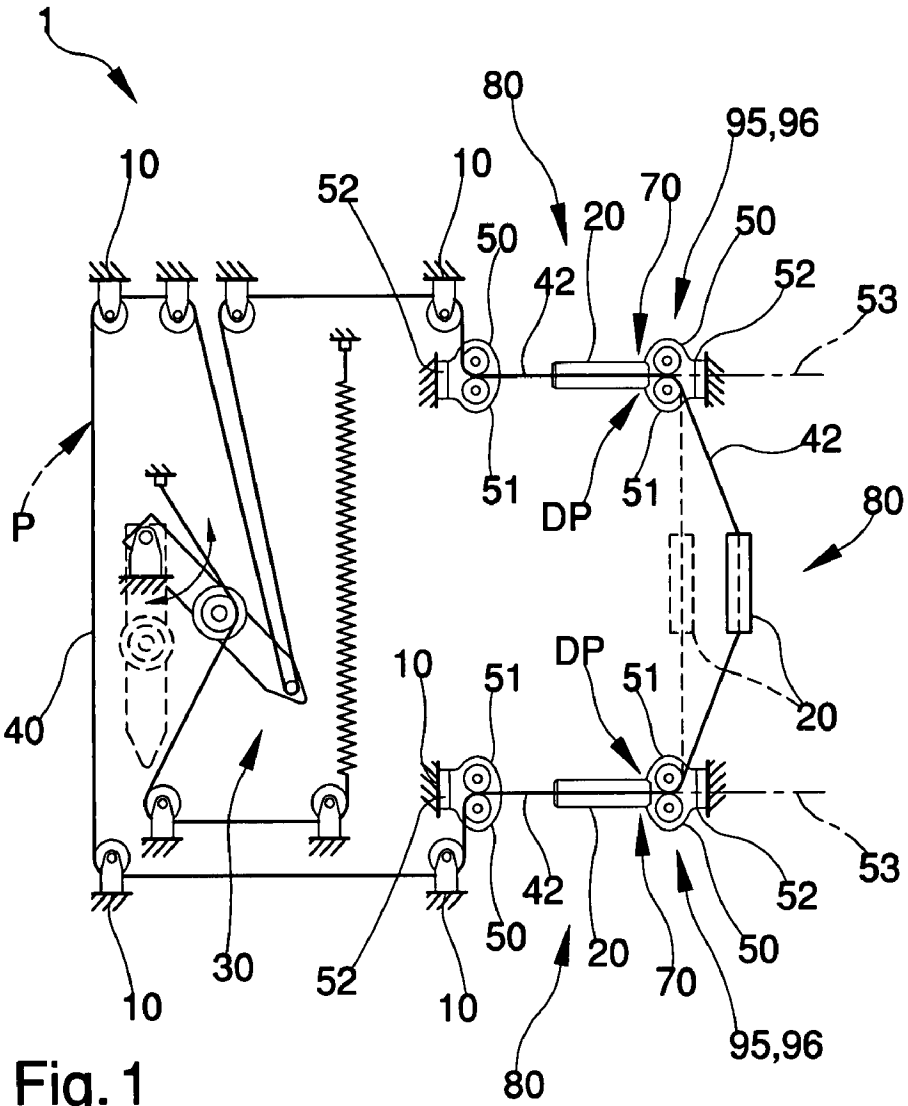
FIG. 1 is a schematic view in lateral elevation of a first preferred embodiment of a gymnastic machine according to the present invention.

In FIG. 1, no. 1 indicates, in its entirety, a gymnastic machine comprising a frame 10 which supports a load group 30 to provide a load resisting a plurality of implements 20, at least one of them located in a respective load station 80. The load group 30, of any kind, is connected to the implements 20 by at least one flexible member, normally a cable 40 made of metal fibres or braided textile fibres. Cable 40 is supported by frame 10 through a plurality of pulley-blocks 50 along a route P, and each implement 20 is coupled to cable 40 and, in particular, to a respective cable run 42 delimited by two of these pulley-blocks 60 consecutive to each other, in a particular way. These pulley-blocks 50 can be identical to each other, of fixed type or of jointed type, as they are represented for simplicity in FIG. 2. In this case, each pulley-block 50 comprises a body with a forked profile 51 which is connectable to frame 10 via an articulated joint 52 rotatable around a determinate axis 53, normally but without limiting effect horizontal or vertical, depending on the design specifications. Each pulley-block 50 also carries, inside the respective fork-shaped body, a pair of pulleys 54, which define a conduit 55 formed in a connecting shank 56, capable of linking pulley-block 50 to frame 10 in freely rotatable manner through the interposition of an anti-friction ring 57.

Naturally, what is described above has valid application both in the case in which at least one implement 20 is coupled in sliding manner to cable 40 in such a way as to leave free all relative longitudinal movement between implement 20 and cable 40 itself, and in the event that at least one implement 20 is coupled rigidly to cable 40 itself, in such a way as to permanently bind implement 20 and cable 40 itself. In this case, it will be possible to vary the rest position of implement 20 between the two corresponding pulley-blocks 50, located on opposite sides of implement 20, by acting on implement 20 itself or on the respective cable 40, because of the rigid connection between the two elements.

Figure 2:
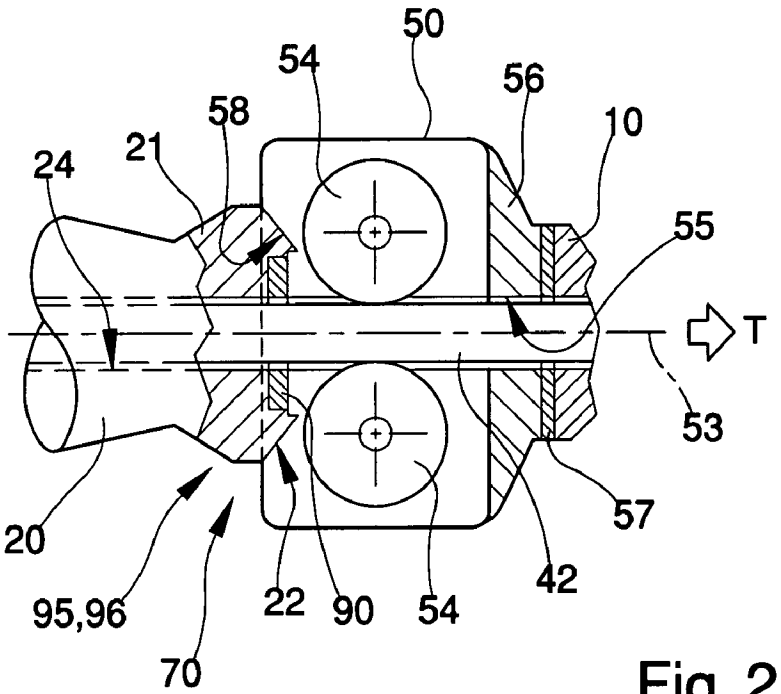
FIG. 2 is a view in lateral elevation, on an enlarged scale, of a detail taken from FIG. 1.

In accordance with FIG. 2, at least one implement 20 is designed to be connected stably with at least one pulley-block 50 or, in the case of an implement 20 coupled to a cable run 42 delimited by a pair of pulley-blocks 50, with one of the two pulley-blocks 50 themselves which delimit the corresponding cable run 42 in the relative gripping station 80. For this reason, at least one cable run 42 of a gripping station 80 presents a corresponding fastening pair 70 comprising both a particular end portion 21 of the implement 20 (visible for simplicity only in FIG. 2), which is located on the side from which, in use, the traction force T applied by a user is exerted, and the pulley-block 50 facing towards portion 21 itself. The two components making up pair 70, once placed in mutual contact according to particular modalities which will be specified below, allow implement 20 to be constrained in neutral conditions for run 42 of cable 40 even when the latter is subjected to alternating traction. It should be noted that each user can selectively bring the implement 20 in question and the corresponding pulley-block 50 closer to each other manually, or bring about their coupling, by applying traction force on cable 40, acting on any run of the latter available to a user.

Pair 70 can be kept assembled by means of a joint of any kind, for example but without limiting effect, by a screw coupling, or a snap connection, or through a magnetic coupling, depending on the design specifications. In FIG. 2, without wishing to cause a limitation to the content of the present description, a pair 70 is illustrated in which it has been decided to combine a conical coupling and a magnetic attraction force, in order to maintain portion 21 and the respective pulley-block 50 in stable connection. This force, as is well-known, acts when the two elements making up the pair are placed at a very close distance and the coupling thus takes place spontaneously.

Still with reference to FIG. 2, it will be noted that the two components making up pair 70 are provided with respective coupling surfaces 22 and 58 which are axially symmetrical and shaped in conjugate manner. In the case in question, without for this reason detracting from the generality of the present description, surfaces 22 and 58 are conical and coaxial with each other and with the tube 24 which passes through implement 20 longitudinally, and with conduit 55, in such a way as to bring about a spontaneous alignment of implement 20 and shank 56 of pulley-block 50 each time pair 70 is brought back together. For convenience of description here and in what follows, position DP will be used to indicate the position of implement 20 with the respective conical surface 22 housed coaxially inside surface 58 of pulley-block 50.

In any event, it is as well to specify that, for reasons of practicality, and without limiting the content of the present description, end 21 of implement 20 is provided with a small annular plate 90 of magnetic type which is housed rigidly in an end position on implement 20 in the direction facing towards the pulley-block 50. The purpose of this plate 90 is thus to hold each implement 20 in the position DP described above. By virtue of what has been said, the uniqueness of the position of implement 20 with respect to pulley-block 50 allows the automatic alignment of the corresponding implement 20 with respect to frame 10, and in particular with respect to the ideal line defined by cable run 42 adjacent to the relative pulley-block 50 with cable 40 maintained in traction in use, at least in the respective gripping station 80.

In addition, this facilitates the return to position of implement 20 on the resumption of training on the same machine 1. By virtue of what has been described above, each implement 20 provided with a respective plate 90 is moved by the friction which occurs in use between the respective tube 24 and the respective run 42 of cable 40, to the respective pulley-block 50, without the manual intervention of a user, but through the simple pull exercised by the user him/herself on cable 40 by means of any other implement 20 located in a different gripping station 80. Naturally, such circumstances can occur both during the continuation of the training session on the same machine 1, and at its conclusion.

It is as well to specify that the decision to construct portion 21 and the relative housing formed in pulley-block 50 is a circumstance which was deliberately chosen for practicality, given that the employment even of a single magnetic plate in association with an implement 20, or of a magnetically sensitive pulley-block 50, would be sufficient to cause mutual attraction and the possibility of orienting implement 20 coaxially with pulley-block 50 and/or the relative run 42 of cable 40, and therefore to create a pair 70 effective from the point of view of the present invention. In addition, at least one of the members which make up pair 70, and in particular portion 21 and pulley-block 50, must present a coupling element or an element which is magnetically sensitive, or physically similar in relation to forces of magnetic interaction. Naturally, the manufacture of portion 21 of implement 20 and/or of the respective pulley-block 50 in magnetic material would also have enabled the achievement of the chosen objectives.

By virtue of what has been described above, each run 42 of cable 40 can be interpreted as an actuating member connected to the respective gripping station (80) and capable, in use, of causing the displacement of the respective implement 20 itself into position DP.

This particular capability is certainly useful in the situation in which a user is engaged in the execution of a considerable number of repetitions of an exercise on the same machine 1, and also for facilitating the use of machine 1 by a visually impaired user. In addition, the presence of magnetically sensitive parts allows the elimination, right from the start, of the problem of having implements 20 which weigh on cable 40 itself, and are subject to banging against the structural limits of each gripping station 80, and disturb the user during training as well as contributing, over time, to the acceleration of the natural deterioration of machine 1 in its entirety.

The method of use of the present machine 1 is easily comprehensible in the light of what has been described above, and does not require further explanation.

In any event, by virtue of what has been described above, each assembly comprising an implement 20 and the respective plate 90 and a pulley-block 50 provided with the respective conical surfaces 22 and 58 identifies a centering device 95, and therefore a silencer, for functional machines with gripping stations 80 provided with implements 20 sliding freely on the cable 40. In addition, the same assembly can be interpreted as a device 96 for automatic restoration of a particular configuration of machine 1, a device which is operable for pulling implement 20 itself, and could be capable of cooperating directly with a particular portion of frame 10, rather than acting indirectly on frame 10 through the medium of pulley-block 50.

Finally, it is clear that modifications and variations may be made to the present gymnastic machine 1 without for this reason departing from the protective compass of the present invention.

What is claimed:

1. A gymnastic machine comprising:

a load group;

at least one gripping station having an implement for the execution of a physical exercise;

a frame supporting the load group and the at least one gripping station, said load group being connected to the implement by a respective cable supported by said frame through a plurality of pulley-blocks along at least one route, with the implement being connected to the respective cable in a freely sliding manner at the at least one gripping station; and return means to selectively restrain the implement along a respective route in at least one determinate position of abutment with a respective fixed counterpart associated to the frame, wherein said return means are suitable, in use, to connect the implement to said frame by means of a magnetic coupling.

2. The machine according to claim 1, wherein said return means includes at least one magnetic member.

3. The machine according to claim 2, wherein the implement includes said magnetic member.

4. The machine according to claim 2, wherein the implement includes a magnetic-sensitive member to be coupleable directly or indirectly to said frame under the action of a magnetic force of attraction.

5. The machine according to claim 1, wherein said respective fixed counterpart includes at least one of said plurality of pulley-blocks.

6. The machine according to claim 1, further comprising:

centering means capable of cooperating with the implement to align and keep aligned, in use, the implement and each cable using a respective pulley-block carried by said frame.

7. The machine according to claim 6, wherein said centering means includes:

a first axially symmetrical surface carried by the implement; and a second axially symmetrical surface carried by each pulley-block, wherein said first and second surfaces are profiled in a conjugate manner so as to be coupleable to each other in a coaxial manner, and to cause an alignment of each cable and the implement in a respective determinate position.

8. The machine according to claim 6, wherein said first and second surfaces have conical profiles.

9. A locking device for a gymnastic machine, with the gymnastic machine having a load group and at least one gripping station, with the gripping station including a respective implement for the execution of a physical exercise, the locking device comprising:

a frame supporting the load group and the at least one gripping station, said load group being connected to the implement by a respective cable supported by said frame through a plurality of pulley-blocks along at least one route, with the implement being connected to each respective cable in a freely sliding manner at the at least one respective gripping station; and return means to selectively restrain the implement along a respective route in at least one determinate position of abutment with a respective fixed counterpart associated to the frame, wherein said return means are suitable, in use, to connect the implement to said frame by means of a magnetic coupling.

10. The locking device according to claim 9, wherein said return means includes at least one magnetic member.

11. The locking device according to claim 10, wherein the implement includes said magnetic member.

12. The locking device according to claim 10, wherein the implement includes a magnetic-sensitive member to be coupleable directly or indirectly to said frame under the action of a magnetic force of attraction.

13. The locking device according to claim 9, further comprising:

centering means capable of cooperating with the implement to align and keep aligned, in use, the implement and each cable using a respective pulley-block carried by said frame.

14. The locking device according to claim 13, wherein said centering means includes:

a first axially symmetrical surface carried by the implement; and a second axially symmetrical surface carried by each pulley-block, wherein said first and second surfaces are profiled in a conjugate manner so as to be coupleable to each other in a coaxial manner.

15. The locking device according to claim 14, wherein said first and second surfaces have conical profiles.

16. A method for the restoration of a predetermined configuration of a gymnastic machine having: a load group; at least one gripping station having an implement for the execution of a physical exercise; a frame supporting the load group and the at least one gripping station, said load group being connected to the implement by a respective cable supported by said frame through a plurality of pulley-blocks along at least one route, with the implement being connected to the respective cable in a freely sliding manner at the at least one gripping station; and return means to selectively restrain the implement along a respective route in at least one determinate position of abutment with a respective fixed counterpart associated to the frame, wherein said return means are suitable, in use, to connect the implement to said frame by means of a magnetic coupling, the method comprising the step of:

restraining the implement at a respective gripping station with respect to a reference member by using the return means.

17. The method according to claim 16, wherein said restraining step is preceded by a step of:

putting under tension at least one flexible member being connected in a sliding manner to the implement.

18. The method according to claim 16, wherein the step of restraining the implement in each respective gripping station with respect to a respective reference member using a magnetic connection includes the step of:

causing a coaxial connection between the implement and each respective reference member to minimize the noisiness of a relative movement between each flexible member and the implement.

19. The method according to claim 16, wherein said return means includes at least one magnetic member.

20. The method according to claim 19, wherein the implement includes said magnetic member.

21. The method according to claim 19, wherein the implement includes a magnetic-sensitive member to be coupleable directly or indirectly to said frame under the action of a magnetic force of attraction.

22. The method according to claim 16, wherein the machine further comprises centering means capable of cooperating with the implement to align and keep aligned, in use, the implement and each cable using a respective pulley-block carried by said frame, wherein said centering means includes:

a first axially symmetrical surface carried by the implement; and a second axially symmetrical surface carried by each pulley-block, wherein said first and second surfaces are profiled in a conjugate manner so as to be coupleable to each other in a coaxial manner, and to cause an alignment of each cable and the implement in a respective determinate position.

* * * * *